US007007533B2

(12) United States Patent
Schmitz et al.

(10) Patent No.: US 7,007,533 B2
(45) Date of Patent: Mar. 7, 2006

(54) ROTATING HEAD

(75) Inventors: David Schmitz, London (GB); Anne Schmitz, Ottawa (CA)

(73) Assignee: Société Bic, (FR)

( * ) Notice: Subject to any disclaimer, the term of this patent is extended or adjusted under 35 U.S.C. 154(b) by 0 days.

(21) Appl. No.: 10/888,426

(22) Filed: Jul. 9, 2004

(65) Prior Publication Data

US 2005/0034498 A1 Feb. 17, 2005

Related U.S. Application Data

(63) Continuation of application No. PCT/FR03/00075, filed on Jan. 10, 2003.

(51) Int. Cl.
*B21D 1/02* (2006.01)

(52) U.S. Cl. ..... 72/112; 72/77; 72/89; 72/121

(58) Field of Classification Search ..... 72/77, 72/78, 89, 112, 120, 121, 122, 123, 126
See application file for complete search history.

(56) References Cited

U.S. PATENT DOCUMENTS 2,498,009 A * 2/1950 Schrader et al. ..... 29/441.1
2,992,572 A * 7/1961 Lockart ..... 29/243.517
3,099,082 A * 7/1963 Henriksen ..... 29/523
3,135,231 A 6/1964 Schachter
4,163,379 A * 8/1979 Buzzi ..... 72/121
4,226,107 A * 10/1980 Buzzi ..... 72/121
4,619,130 A * 10/1986 Buzzi ..... 72/124

FOREIGN PATENT DOCUMENTS

JP 62-3841 * 1/1987

* cited by examiner

*Primary Examiner*—Ed Tolan
(74) *Attorney, Agent, or Firm*—Jones Day

(57) ABSTRACT

The invention relates to a device called a rotating head which is used to deform the edge of the points or nibs of ball-point pens. The inventive device has two rotating rolls which are installed so that they can pivot freely in the rotating head. The rotating rolls can turn freely around aligned axes. The rolls each have forming disks and are arranged to define a gap between the front surfaces of the forming disks. A tongue having a V-shaped end face is disposed in the gaps and can be moved against a spring. The tongue engages a tip ball in a nib positioned between the rotating rolls to be formed into a finished nib.

12 Claims, 1 Drawing Sheet

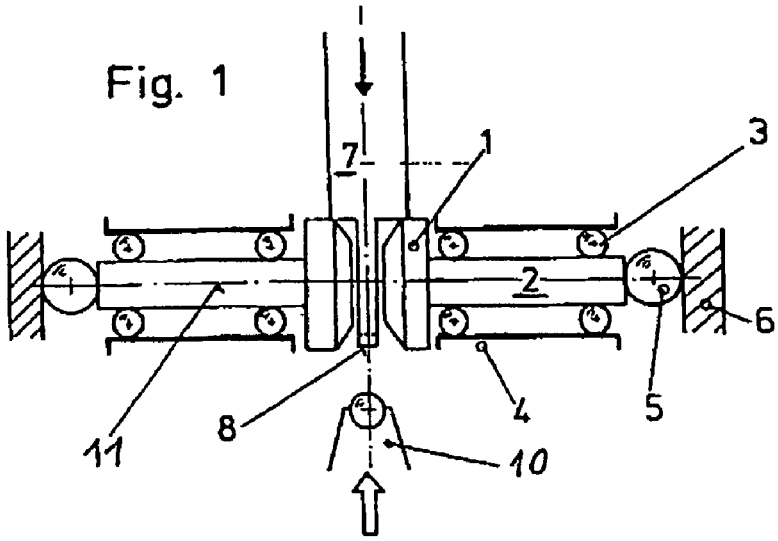
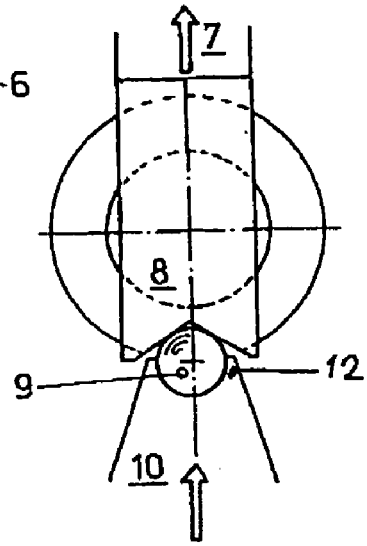
Fig. 3
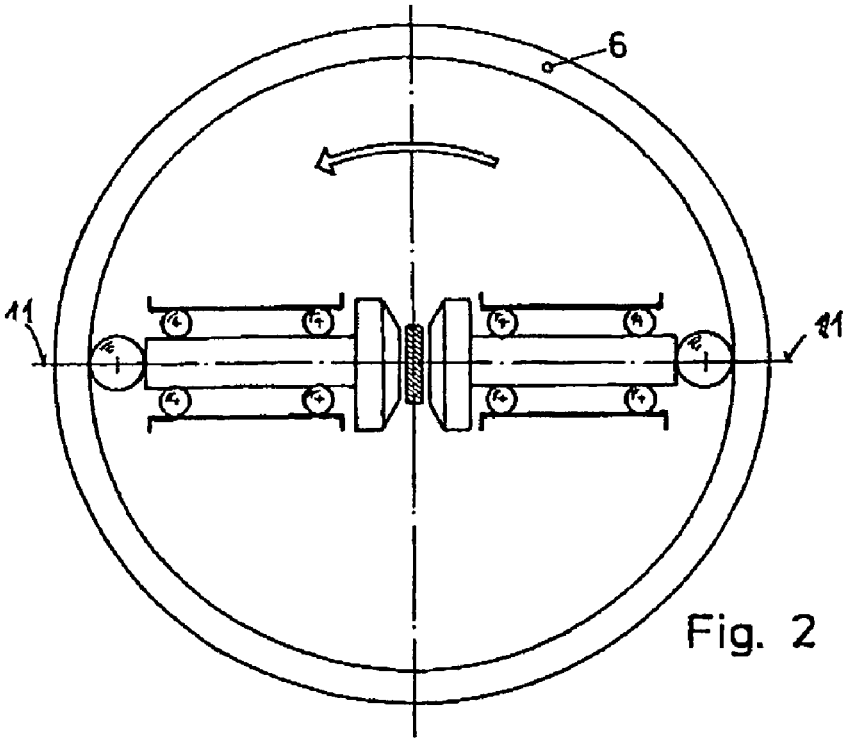
Fig. 2

ROTATING HEAD

CROSS-REFERENCE TO RELATED APPLICATIONS

The present application is a continuation of co-pending International Patent Application PCT/FR03/00075, filed on Jan. 10, 2003, which claims priority to European Patent Application No. 02450004.3, filed Jan. 10, 2002. The entire content of both these applications is expressly incorporated herein by reference.

FIELD OF THE INVENTION

The present invention relates to a device known as a rotating head for deforming the edges of ballpoint-pen nibs.

BACKGROUND OF THE INVENTION

Ballpoint pens typically have hard tip balls mounted in nibs made of formable material. When mounting the hard balls in their seat in the nib of the ballpoint pen, the balls are first inserted into a generally cylindrical blind hole and then the edge of the nib that extends above the equator of the ball is flanged by plastic deformation so as to surround and to hold the ball in the zone "above" the equator.

The hole in which the ball sits has sockets or grooves in its inner end region to allow the writing fluid (hereinafter termed "ink" for simplicity) to be transported. Nor is the hole actually blind, because from its inner end region a bore whose diameter is less than that of the ball leads to the ink reservoir.

The flanging of the edge has been carried out for many years by, for example, the following method disclosed in U.S. Pat. No. 3,135,231. The flanging device, termed the rotating head, has two rods set parallel to and spaced part from each other and oriented in the vertical direction. At their lower ends, the rods support hard forming disks of circular shape which taper generally conically in a downward direction. The assembly formed by the rod and the forming disk is known as the rotating roll and is installed in such a way as to be able to pivot freely. The peripheries of the forming disks comprise a small interval in the form of a gap. In the center of this gap is a hard, thin tongue with a V-shaped end surface that can move axially against a spring. The rotating head can rotate about the axis of symmetry of the two shafts of the forming disks and is also rotated about this axis.

The method of operation is thus as follows. A nib with its ball is guided coaxially relative to the axis of rotation of the rotating head in the gap between the forming disks and the ball then firstly contacts the V-shaped front surface. The ball and the nib are thus positioned centrally and securely in the plane of the tongue. The tongue is then displaced against its spring and the nib arrives in contact with the forming disks installed in such a way as to be able to pivot freely. This results in centering in the plane normally with respect to the plane of the tongue. The axial compression of the nib and of the rotating head against each other takes place with a predefined force as a result of a predefined number of relative rotations. The relative movement between the nib and the rotating head produces an offset in terms of rotation of the forming disks. Thus, because of the compressive force and because of the series of rotations, the edges of the forming disks are compressed against the ball and the formable material of the edge is densified and drawn, which creates an approximately concentric gap around the ball in the area of the equator. The flanging operation is thereby completed.

This apparatus is tried and tested and more than half of all ballpoint pens made worldwide are made by this process and with such devices.

This device does however have a drawback which is due to the predefined geometrical ratios of size within narrow limits of the various components. Because there are two shafts oriented parallel to the forming disks, it is impossible, even with extreme miniaturization and using special flat-mounting bearings in the radial direction, to achieve a gap between the two axes of rotation that is less than about 10 mm. The diameters of the forming disks are thus also unavoidably fixed at approximately 10 mm each. The nib usually has a diameter of about 0.6 to 1.2 mm in the region of its edge and it is therefore sharply curved. The nib: forming-disk-curvature ratios thus range from about 1:16 to 1:8. These size ratios result in a relatively large contact area and thus a low Hertz surface pressure. With a higher Hertz surface pressure there is better "kneading" of the nib material. The most effective way to achieve this is to reduce the contact area, which can be done by increasing the ratio of curvature to 1:4 for example.

Another drawback of the already known device is that it is difficult to adjust the axial position of the two forming disks accurately.

U.S. Pat. No. 3,135,231 also discloses an embodiment in which the two rods of the forming disks are not arranged parallel to the axis of rotation of the rotating head, but obliquely to the latter, so that their axes intersect the axis of rotation. The reason for this arrangement is not indicated, nor is it used in practice probably because of the high cost of manufacture of non-parallel seats for the bearings of the rods.

SUMMARY OF THE INVENTION

The present invention provides a device in which the curvature ratios indicated above are achieved and in which the desired position of the forming disks can be achieved.

The present invention uses two forming disks with aligned axes. The front surfaces of the forming disks are situated opposite each other with a gap therebetween. By this means, the diameter of the forming disks can be kept substantially smaller than in the prior art.

BRIEF DESCRIPTION OF THE DRAWINGS

The invention is explained in more detail below on the basis of the drawings, in which:

FIG. 1 is a diagrammatic view of a rotating head according to the invention;

FIG. 2 is a diagrammatic view of the top of the device of FIG. 1; and

FIG. 3 is a detail on an enlarged scale.

DETAILED DESCRIPTION OF THE INVENTION

As seen in FIG. 1, the rotating head according to the invention has two forming disks 1 with coaxially arranged rods 2. The assembly formed by the forming disk and the rod, which is usually made in one piece, is referred to hereinbelow as a rotating roll. Rods 2 are guided radially by balls 3 held in ball cages (not shown). The axial positioning of each rod 2 is achieved by means of a ball 5 resting on the end surface of rod 2 furthest from the forming disk 1. The ball 5, which is also held in a ball cage (not shown) bears against a bearing surface 6 of the rotating head. (The bearing surface 6 is formed by a part placed on top.) Balls 5 and the total length of the rotating rolls define the position of the gap and the position of the rotating profile of the forming disks.

Each forming disk 1 basically has a front surface and a rotating profile, which in this application means the part of the surface that shapes the edge. The small dimensions of the forming rolls can be seen by comparing their size with the nib, also shown. Compared with the prior art, a substantial reduction is thus also achieved in the mass of the rotating rolls, which are preferably made of tungsten carbide. Due to the substantial reduction in the diameter to about 4 mm, the abovementioned ratio of curvature (nib: forming-disk-curvature) of 1:4 and more sought by the invention is achieved.

Between the mutually opposed front surfaces there extends a tongue 8 loaded by a spring in the axial direction (the downward arrow in FIG. 1), the V-shaped front surface of which can be seen very clearly particularly in FIG. 3. The tongue 8 is guided by a rod 7, of which it forms the forward end. Also visible in FIG. 3 is a nib 10, in which ball 9 is inserted. Ball 9 has already slightly displaced the tongue against the force of the spring in the direction of the arrow.

The shoulder at the transition between rod 7 and tongue 8 is located in FIG. 1 on the periphery of forming disks 1—the forming disks are immobile. In FIG. 3 this shoulder is already slightly raised and allows the forming disks to rotate as the nib 10 continues to move in the direction of the arrow until contact is made with the forming disks.

In the final phase of the relative movement between the nib and the rotating head, the plastic deformation of the edge takes place while forming the known curved ink gap, mentioned above (in the Summary Of The Invention), concentrically with the ball 9.

The invention is not limited to the illustrative embodiment presented, but can also be modified and organized differently. In the description, the rotating head is always positioned above the nib, but this is not compulsory. The axis of rotation between the rotating head and the nib may also extend horizontally. Where the axis of rotation is vertical, the nib may be moved downwards into the rotating head which is beneath it. The position of the bearing surface 6 can also be modified using an adjustment mechanism (adjusting screw, shim, etc.)—it need not necessarily be the circular shape illustrated in FIG. 2. The movements which were defined in the example as upward and downward movements of the writing head and the rotational movement of the rotating head may be realized in some other way. It has been found to be advantageous for the rotating head to turn about its main axis but not to be mobile in the axial direction. The nib does not rotate but moves axially until the writing ball makes contact with first one flank, then the other flank of the spring-loaded V-shaped tongue. As the nib continues to advance toward the rotating head, the nib is placed in contact with the two forming disks and is also centered in the direction at a right angle to the V-shaped tongue. Lastly, the forming disks, installed in such a way as to be able to pivot freely, are offset in terms of rotation due to the rotation of the rotating head during the continuation of the axial movement and deformation of the edge takes place.

In one particularly interesting embodiment of the invention, the nib rests in a clamp which is installed with a slight radial play in order to ensure that, despite any geometrical defects in both the nib and the device, the nib can be positioned centrally without difficulty as described above. Advantageously, the support of the nib has a radial play of not more than 0.2 times the diameter of the ball.

The axial advance follows a controlled curve and is limited by a fixed stop. The maximum advancing force can also be limited by a spring acting axially. This spring must first overcome the counterforce exerted by the much weaker springs (located inside the rotating head) of the V-shaped tongue and thus provides the force to deform the edge.

It is important that the forming disks be first offset in terms of rotation by contact with the edge, with a negligible amount of sliding. This is achieved by virtue of the low mass achieved by the invention for the rotating rolls and their bearings and by virtue of the Hertz pressure force between the rotating rolls and the edge.

What is claimed is:

1. A rotating head for deforming the edge of ballpoint pen nibs, said rotating head comprising:

two rotating rolls installed to be freely pivotable in said rotating head, and having forming disks with front surfaces spaced apart by a gap; and a tongue extending through said gap and comprising a V-shaped front face moveable against a spring;

wherein said rotating rolls are freely rotatable about coaxial axes.

2. The rotating head as claimed in claim 1, wherein the axial position of each rotating roll is defined by a respective bearing surface of said rotating head.

3. The rotating head as claimed in claim 2, wherein the position of said bearing surface is adjustable.

4. The rotating head as claimed in claim 2, wherein:

said tongue is part of a rod; and said rod has at least one shoulder resting, under the force of a spring, on the periphery of at least one of said forming disks.

5. The rotating head as claimed in claim 4, wherein when said V-shaped tongue is in a rest position, the axial distance between the flanks of the V-shaped profile and said forming disks ensures that a ball in a ballpoint-pen nib touches both flanks of the V-shaped profile before the edge of the nib comes into contact with the forming disks.

6. The rotating head as claimed in claim 1, wherein:

said tongue is part of a rod; and said rod has at least one shoulder resting, under the force of a spring, on the periphery of at least one of said forming disks.

7. The rotating head as claimed in claim 6, wherein the support of the nib has a radial play of not more than 0.2 times the diameter of the ball.

8. A rotating head for deforming the edge of a hollow ballpoint-pen nib, said rotating head comprising:

a pair of forming disks rotating about the same axis, each forming disk having a front surface and a rotating profile configured to shape the edge of a nib, said rotating disk front surfaces being spaced part by a gap so that said rotating profiles are adjacent each other to shape a nib positioned therebetween.

9. A rotating head as claimed in claim 8, further comprising:

a tongue extending between said gap.

10. A rotating head as claimed in claim 9, wherein said tongue is guided by a spring.

11. A rotating head as claimed in claim 8, wherein said rotating disks are mounted on coaxially arranged rods.

12. A rotating head as claimed in claim 11, wherein:

said rods are guided radially by balls; and the axial position of each said rod is achieved by a ball resting on an end surface of each said rod and supported by a bearing surface of said rotating head.

* * * * *